United States Patent [19]

Armand et al.

[11] Patent Number: 4,675,084

[45] Date of Patent: Jun. 23, 1987

[54] PROCESS FOR IMPROVING THE PURITY OF TRANSITION METALS PRODUCED BY ELECTROLYSIS OF HALIDES THEREOF IN A BATH OF MOLTEN SALTS

[75] Inventors: Marcel Armand, Meylan; Jean-Pierre Garnier, Rugles, both of France

[73] Assignee: Pechiney, Paris, France

[21] Appl. No.: 829,937

[22] Filed: Feb. 18, 1986

[30] Foreign Application Priority Data

Mar. 19, 1985 [FR] France ..... 85 04596

[51] Int. Cl.[4] ..... C25C 3/00

[52] U.S. Cl. ..... 204/64 R; 204/64 T

[58] Field of Search ..... 204/64 R, 64 T

[56] References Cited

U.S. PATENT DOCUMENTS

| | | | |
|---|---|---|---|
| 476,914 | 6/1892 | Bernard | 204/196 |
| 2,937,128 | 5/1960 | Raynes et al. | 204/64 T |
| 2,975,111 | 3/1961 | Reimert et al. | 204/64 T |
| 3,082,159 | 3/1963 | Reimert | 204/64 T |

FOREIGN PATENT DOCUMENTS

| | | | |
|---|---|---|---|
| 0805767 | 12/1958 | United Kingdom | 204/64 R |

*Primary Examiner*—R. L. Andrews

*Attorney, Agent, or Firm*—Dennison, Meserole, Pollack & Scheiner

[57] ABSTRACT

The present invention relates to a process for improving the purity of transition metals produced by electrolysis of halides thereof in a bath of molten salts in a tank having a metal internal wall.

The process is characterised in that a cathodic potential with respect to the anode of the cell is permanently imposed on the tank.

It finds application in the production of metals such as in particular titanium, zirconium, hafnium, vanadium, niobium and tantalum, with a low proportion of oxygen and foreign metal elements.

4 Claims, No Drawings

PROCESS FOR IMPROVING THE PURITY OF TRANSITION METALS PRODUCED BY ELECTROLYSIS OF HALIDES THEREOF IN A BATH OF MOLTEN SALTS

The present invention which results from the work done in the laboratories of the 'Ecole Nationale Superieure d'Electrochimie et d'Electrométallurgie' (National College of Electrochemistry and Electrometallurgy) at Grenoble, relates to a process for improving the purity of transition metals produced by continuous electrolysis from halides thereof which are dissolved in a bath of molten salts formed by alkali metal and/or alkaline earth halides.

Hereinafter in this specification:

1. The term transition metals is used to denote generally polyvalent metals having a melting point of higher than 1400° C. and having a relatively high degree of affinity for oxygen when they are heated such as those in columns IVB, VB and VIB of Mendeleev's Periodic Table and in particular titanium, zirconium, hafnium, tantalum, niobium and vanadium.

2. The term continuous electrolysis is used to denote a process in which deposit and extraction of the metal at the cathode and the release of halogen at the anode are permanently compensated by a make-up of fresh halide which is intended to maintain the proportion of metal to be produced that is dissolved in the bath at an approximately constant level.

It is known that baths of molten alkali metal and/or alkaline earth halides which are used for the preparation of transition metals from halides thereof always contain metallic and metalloidic impurities, irrespective of the precautions taken in the course of preparation thereof. In particular, because of the more or less pronounced hygroscopicity of their constituents, oxygen is always present either in solution or in the form of oxides which are more or less in suspension. At least over a period of greater or lesser length, the direct use of such baths gives rise to metals which are polluted with metallic impurities that are less electronegative than the metal to be produced, and in particular with oxygen. Moreover, in the case of continuous processes, the subsequent additions of salts which are intended to compensate for the losses caused by extraction of the metal and the usual impurities contained in the halide of the metal to be produced such as for example iron, aluminium, oxygen, etc constitute a permanent source of pollution in respect of those various impurities.

As regards the initial bath itself, the level of purity may be improved by a preliminary electrolytic treatment which is referred to as pre-electrolysis, in the course of which a dc voltage which is slightly lower than that required to achieve decomposition of the alkali metal or alkaline earth halide which is easiest to reduce, is established between two electrodes which are immersed in the molten bath which does not yet contain halides of the metal to be deposited. The density of the current which results therefrom depends on the levels of concentration in respect of elements to be eliminated but it is generally very low, of the order of $10^{-3}A/cm^2$, and it falls further in the course of operation. Accordingly, the pre-electrolysis operation takes up a very long period of time.

A pre-electrolysis process which provides a higher level of performance has been proposed in U.S. Pat. No. 2,782,156.

It still comprises establishing a dc voltage between electrodes which dip into the bath, but in this case the bath is charged with halide of the metal to be produced and the voltage imposed is higher than the voltages necessary to effect deposit of the metal in question at the cathode and sufficient to effect decomposition of the water and the salts and oxides of the polluting elements and deposit of said elements at the cathode. That pre-electrolysis operation which involves a constant current strength is maintained for a sufficient period of time to ensure that the major part of the water and the polluting elements has been removed from the bath of salts as well as a small part of the transition metal to be produced. As the current density is at least equal to half that used for the electrolysis operation in the true sense, that is to say 0.2 to 0.255 $A/cm^2$ in the case of the patent, the pre-electrolysis operation is relatively short in duration, for example half an hour under the conditions set forth in Exaxple 1.

Although that procedure represents a substantial advance in comparison with that discussed previously, it has the disadvantage that it still cannot be applied to discontinuous operations in which the bath, once purified, is depleted in respect of transition metal and must then be restored to its initial ccmposition by the addition or removal of salts, recharged with halide of the metal to be produced, and again subjected to the purification treatment.

It is for that reason that, the aim of the applicants being further to improve the level of purity of the transition metals which are produced by electrolysis of halides thereof, they developed a purification process which can be applied to continuous operations, that is to say not only in the initial period but also throughout the entire period of production, comprising in particular more or less continuous make-up operations in respect of salts and halide of the metal to be produced.

The research which was undertaken along those lines resulted in the development, in cells comprising on the one hand a tank with a metal internal wall containing the molten bath and on the other hand a cover for sealing off the tank, which is electrically insulated from the tank and which has various orifices for receiving inter alia anodic and cathodic devices which pass therethrough to dip into the bath, a feed to that bath with halide of the metal to be produced and extraction of the halogen which is given off at the anode, of a process characterised in that a cathodic potential with respect to the anodic device is permanently imposed on the tank.

The invention therefore applies to electrolysis cells in which the metal tank containing the bath of molten salts does not have any internal refractory lining and is thus in direct contact with the bath. The metal which forms the tank is selected from those metals which have good chemical resistance to salts and halides of the transition metals. The metal may be in particular nickel and alloys thereof or more simply a stainless steel.

The tank is connected in known manner to an electrical circuit in such a way as to establish a polarisation current in contact with the bath and the tank.

Preferably, the applied potential makes it possible to establish a polarisation current of a current density of between $0.5 \cdot 10^{-4}$ and $5 \cdot 10^{-4} A/cm^2$. Under those conditions it is found that the electrolysis operation which is carried out in accordance with the usual criteria in respect of voltage and current density as between anode and cathode results in a metal with an improved level of purity in comparison with that obtained without polarisation of the tank; that improvement is achieved at the expense of a slight loss in metal in highly polluted form which is deposited on the wall of the tank.

The density range used is explained by virtue of the fact that, below a value of $0.5 \cdot 10^{-4}$a/cm$^2$, polarisation is not sufficiently effective while above a value of $5 \cdot 10^{-4}$A/cm$^2$ it is found to be redundant as it gives rise to a useless loss of metal without a noticeable improvement in the state of purity of the metal which is collected at the cathode.

The applicants further found that it was possible to impress a cathodic potential with respect to the anode on the tank, but with a higher current density, as a means for pre-electrolysis on starting up the cell. In fact, if before starting the electrolysis operation in the true sense as between the anode and the cathode, and when the molten bath is charged with halide of the metal to be produced, the tank is so polarised as to have a current density of between $1 \cdot 10^{-2}$A/cm$^2$ and $5 \cdot 10^{-2}$A/cm$^2$, that produces, on the walls of the tank, a deposit of metal which is polluted with oxygen and foreign metallic elements which are less electronegative than the metal to be produced and which are accordingly rapidly eliminated from the bath.

The claimed current density range takes account of the fact that below a value of $1 \cdot 10^{-2}$A/cm$^2$ the duration of the operation becomes prohibitive while above a value of $5 \cdot 10^{-2}$A/cm$^2$, the losses of metal become more substantial without noticeable benefit in regard to the purification effect. The deposit of metal on the tank, in the ultimate analysis, represents only a very small thickness (a few tenths of millimetres) and it does not give rise to problems in regard to the subsequent electrolysis operation, at least as long as the conditions for polarisation of the tank, as referred to above, are fulfilled: current density of between $0.5 \cdot 10^{-4}$A/cm$^2$ and $5 \cdot 10^{-4}$A/cm$^2$.

The invention may be illustrated by reference to the following Examples of use thereof:

EXAMPLE 1

Using a cell made of refractory stainless steel and provided with an anodic device and a cathode, 200 kg of an equi-molecular mixture of NaCl and KCl, which had been previously dried at 500° under vacuum is charged into the cell; after melting at a temperature of 750° C. and the introduction of 11.5 kg of $HfCl_4$, the following three electrolysis operations were carried out, in the course of which the proportion of hafnium dissolved in the bath was maintained at a constant value by virtue of an addition of chloride at a rate of 1 mole for 4 Faradays.

1. An electrolysis operation for half an hour at 200 A on a cathode of an area of 400 cm$^2$ (current density 0.5 A/cm$^2$) provided 160 g of metal hafnium containing the following main impurities:

| | |
|---|---|
| Oxygen | 5000 ppm |
| Iron | 870 ppm |
| Chromium | 1.30% |
| Nickel | 53 ppm |
| Zirconium | 0.87% |
| Manganese | 1400 ppm |
| Aluminium | 307 ppm |
| Copper | 165 ppm |
| Titanium | 56 ppm |

which indicates a highly polluted bath.

2. An electrolysis operation was then carried out, for a period of 6 hours at 200 A, using the tank itself as the cathode (current density $2 \cdot 10^{-2}$A/cm$^2$), corresponding to a deposit of 2 kg of metal hafnium on the wall of the tank, that is to say, a mean thickness of the order of 0.15 mm.

3. A fresh electrolysis operation lasting for half an hour at 200 A on a cathode of 400 cm$^2$ then produced 163 g of metal corresponding to the following analysis:

| | |
|---|---|
| Oxygen | 340 ppm |
| Iron | <20 ppm |
| Chromium | <10 ppm |
| Nickel | <10 ppm |
| Zirconium | 0.83% |
| Manganese | 24 ppm |
| Aluminium | 50 ppm |
| Copper | <10 ppm |
| Titanium | <10 ppm |

which indicates excellent purification of the bath. With the process involving pre-electrolysis without deposit of metal on the tank, that result could not have been achieved in less than 1000 hours.

EXAMPLE 2

Still using the same cell after the third electrolysis operation described in Example 1, a fourth electrolysis operation was carried out over a period of half an hour at 200 A on a cathode of 400 cm$^2$, but this time imposing on the tank a cathodic polarisation current of 2 A, that is to say a current density of $2 \cdot 10^{-4}$A/cm$^2$; 162 g of metal was then collected containing not more than 130 ppm of oxygen, all the other impurities being less than 10 ppm, apart from zirconium: 0.8%.

In the course of the subsequent electrolysis operations and under the same conditions, it was possible to deposit 40 kg of Hf with less than 200 ppm of oxygen, in spite of a continuous feed of $HfCl_4$ and several operations of adding salt.

The present invention finds application in the production by continuous electrolysis in a bath of molten salts of transition metals with a low proportion of oxygen and foreign metal elements.

What is claimed is:

1. In a process for producing a transition metal by electrolysis of a transition metal halide in a bath of molten salts in a cell comprising a tank having a metal internal wall containing the bath, a cover for sealing off the tank which is electrically insulated from the tank and which includes a plurality of orifices, at least one anodic device passing through one said orifice into the bath, at least one cathodic device passing through a second said orifice into the bath, at which said transition metal is produced, means to feed said transition metal halide to the bath, and means to extract a halogen produced at the anodic device, the improvement comprising permanently maintaining on said internal wall of said tank a cathodic potential with respect to said anodic device and a lower current density than said at least one cathodic device, said lower current density being sufficient to produce on said wall a deposit of said transition metal which is polluted with oxygen and foreign metallic elements which are less electronegative than said transition metal, recovering said polluted transition metal from said wall, and separately recovering from said at least one cathodic device said transition metal which is of improved purity.

2. A process according to claim 1, wherein the current density at said internal wall is between $0.5\times10^{-4}$ and $5\times10^{-4}A/cm^2$.

3. A process according to claim 1 additionally comprising the step of imposing cathodic potential on said internal wall prior to imposing a potential on said cathodic device to remove some oxygen and metallic impurities from the bath.

4. A process according to claim 3, wherein the current density at said internal wall is between $1\times10^{-2}$ and $5\times10^{-2}A/cm^2$, prior to imposing the potential on said cathodic device.

* * * * *